United States Patent [19]

Ebihara

[11] Patent Number: 4,763,824

[45] Date of Patent: Aug. 16, 1988

[54] STAPLER CASSETTE

[76] Inventor: Yoshiyuki Ebihara, 25-18, Kamiogi 4-chome, Subinami-ku, Tokyo, Japan

[21] Appl. No.: 28,864

[22] Filed: Mar. 23, 1987

[30] Foreign Application Priority Data

Aug. 15, 1986 [JP] Japan ..... 61-191415

[51] Int. Cl.[4] ..... B25C 7/00

[52] U.S. Cl. ..... 227/120; 227/109; 227/132

[58] Field of Search ..... 227/120, 109, 125, 126, 227/127, 132

[56] References Cited

U.S. PATENT DOCUMENTS

| | | | |
|---|---|---|---|
| 3,263,888 | 8/1966 | Wandel | 227/132 |
| 3,347,439 | 10/1967 | Doherty | 227/132 X |
| 3,958,738 | 5/1976 | Tremblay | 227/109 |
| 4,546,909 | 10/1985 | Ebihara | 227/120 |
| 4,607,777 | 8/1986 | Ebihara | 227/120 |

*Primary Examiner*—Paul A. Bell

*Attorney, Agent, or Firm*—Andrus, Sceales, Starke & Sawall

[57] ABSTRACT

A stapler includes a base, a cassette mounting member pivotally mounted on the base and a handle pivotally mounted on the cassette mounting member. The handle includes a driving blade at its forward end. The cassette includes an elongated cassette body of substantially U-shaped cross-section having parallel side walls spaced apart from each other, and a top wall connecting the side walls at their tops and having a forward end formed with a staple driving aperture through which the handle's driving blade can pass. The cassette body has a closed forward end and an open rearward end. A staple guide of substantially H-shaped cross-section is mounted coextensively on the open bottom of the cassette body to form a coextensive space. The staple guide includes a pair of opposed parallel leg portions which extend from near the open bottom of and toward the top wall of the cassette body. A transverse connecting portion connects the leg portions near their lower ends. The top of each leg portion is spaced apart from the inner face of the top wall of the cassette body. The outer side face of each leg portion is spaced apart from the inner face of the corresponding side wall of the cassette body. A slideable feeder element is engageable with the rearwardmost staple of a staple set charged into the formed space, and a resilient device resiliently urges the feeder element against the closed forward end of the cassette body.

3 Claims, 5 Drawing Sheets

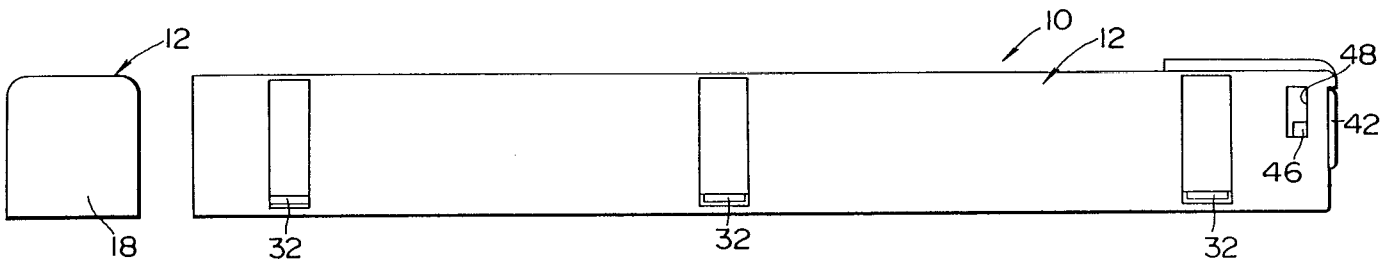
FIG.3
FIG.4
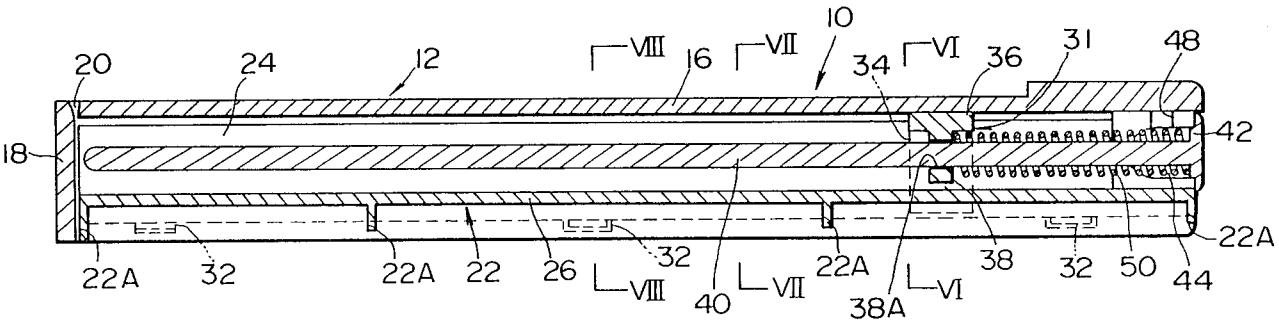
FIG.5

STAPLER CASSETTE

BACKGROUND OF THE INVENTION

1. Field of the Invention

The present invention relates to a cassette type stapler and more particularly to a cassette suitable for use in large-sized staplers which are utilized to bind a great number of documents.

2. Description of the Prior Art

There is known a cassette type stapler comprising a base member, a cassette mounting member pivotally mounted on the base member and a handle member pivotally mounted on the cassette mounting member, the handle member including a driving blade which is located thereon substantially at the forward end of the handle member. In such a stapler, a certain cassette can contain only one type of staples. With a so-called heavy-duty stapler known in the art and if it is found that staples charged in the heavy-duty stapler are not suitable for use in the thickness of sheets to be bound, a cassette containing such staples is removed from the stapler and another cassette containing staples suitable for the set of sheets to be bound is then charged into the stapler to bind this set of sheets. On completion of the binding and when it is wanted to bind another set of sheets having a different thickness, the previously used and remaining staples should be removed from the stapler and still another staples of a further different size should then be charged into the stapler. Thus, such removal and charge of staples would be repeated for various different thicknesses of sheet set to be bound. At this time, it is possible that the temporarily connected staples are disintegrated and that the disintegrated staples result in injury to the finger(s) of an operator. In any event, the exchange of staples in the prior art staplers was cumbersome.

SUMMARY OF THE INVENTION

It is therefore an object of the present invention to provide a new and unique stapler cassette which can receive staples having various different sizes.

The term "size" herein indicates the height of legs in a single staple.

To this end, the present invention provides a cassette suitable for use in cassette type staplers of the above-mentioned type, the cassette comprising an elongated cassette body of substantially U-shaped cross-section having parallel side walls spaced apart from each other and a top wall connecting said side walls at their tops, said top wall having a forward end formed with a staple driving aperture through which the driving blade of the handle member can pass, said cassette body having a closed forward end and a opened rearward end, a staple guide member of substantially H-shaped cross-section mounted on the opened bottom of said cassette body substantially through the length of the cassette body to form a space extending along the length of said cassette body, said staple guide member including a pair of parallel leg portions opposed to each other and extending from near said opened bottom toward the top wall of said cassette body and a transverse connecting portion connecting these leg portions near the lower ends of said leg portions, the top of each of said leg portions being spaced apart from the inner face of the top wall of said cassette body, the outer side face of each of said leg portions being spaced apart from the inner face of the corresponding side wall of said cassette body, and feeder means slidably mounted within said space, said feeder means including a feeder element engageable with the rearwardmost staple of a staple set charged into said space and resilient means for resiliently urging said feeder element against the closed forward end of said cassette body.

When a plurality of such cassettes are used for a single cassette type stapler, each of the cassettes having the same size and configuration receives a set of staples different in size from staples to be received in the other cassettes. Thus, if a first set of staples having a size is to be replaced by a second set of staples having another size, a cassette containing the first set of staples can simply be replaced by another cassette containing the second set of staples.

BRIEF DESCRIPTION OF THE DRAWINGS

FIG. 3 is a side view of the cassette shown in FIG. 2.

FIG. 4 is a front elevational view of the cassette shown in FIG. 2.

FIG. 5 is a longitudinal section of the cassette shown in FIGS. 2 to 4.

DETAILED DESCRIPTION OF PREFERRED EMBODIMENTS

Figure 1:
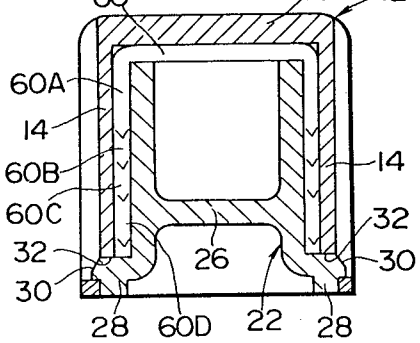
FIG. 1 is a cross-sectional view of a first embodiment of a cassette constructed in accordance with the present invention with staples having different sizes to be received in the cassette being exemplified.
Figure 2:
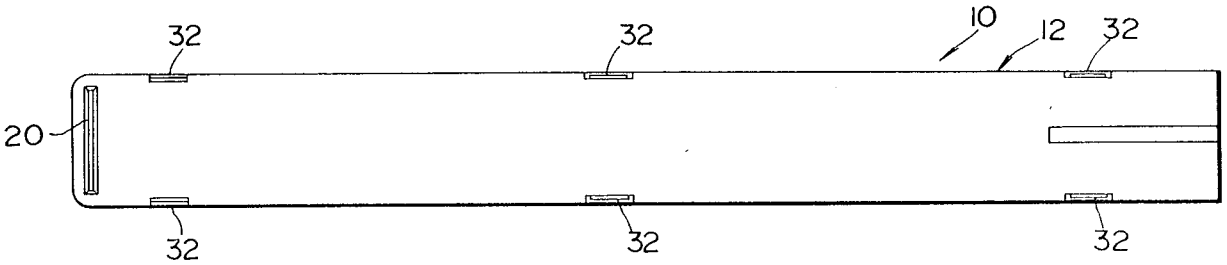
FIG. 2 is a plan view of the cassette shown in FIG. 1.

Referring first to FIGS. 2 through 10, there is shown a cassette 10 including an elongated cassette body 12 of substantially inverted U-shaped cross-section. The cassette body 12 includes two parallel side walls 14 opposed to each other and a top wall 16 connecting these side walls 14 at their tops. Thus, the cassette body 12 will have its opened bottom. The forward end of the cassette body 12 is closed by an end wall 18 with the rearward end thereof being opened. As will be described, the opened rearward end of the cassette body 12 may be closed by a cap. The top wall 16 of the cassette body 12 is formed with a staple driving aperture 20 directly behind the forward end wall 18 thereof, through which aperture 20 a driving blade (not shown)

on a well-known handle member (not shown) will pass. On passage of the driving blade through the staple driving aperture 20, the forwardmost one of staples, which are set within the cassette body 12 as will be described, will be driven, for example, into a stacked set of documents to bind them. This is apparent for a person skilled in the art and will not further be described herein.

Figure 8:
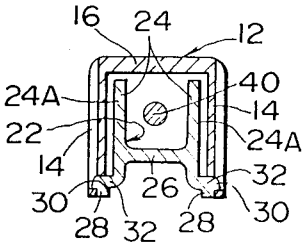
FIG. 8 is a cross-sectional view of the cassette taken along a line VIII—VIII in FIG. 5.
Figure 7:
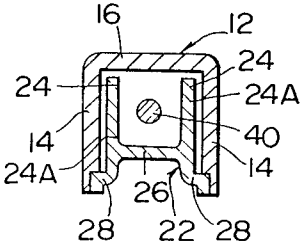
FIG. 7 is a cross-sectional view of the cassette taken along a line VII—VII in FIG. 5.
Figure 6:
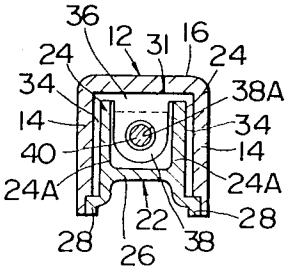
FIG. 6 is a cross-sectional view of the cassette taken along a line VI—VI in FIG. 5.
Figure 10:
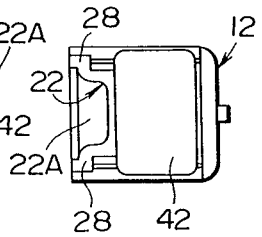
FIG. 10 is a back view of the cassette shown in FIG. 9.
Figure 9:
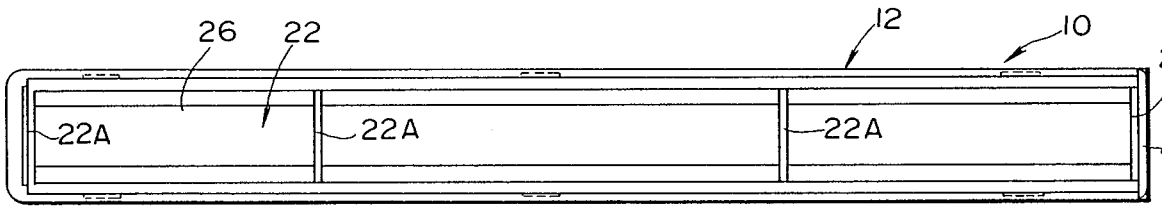
FIG. 9 is a bottom view of the cassette shown in FIG. 5.

As seen particularly from FIGS. 6 to 8, a staple guide member 22 is mounted in the opened bottom of the cassette body 12 and extends substantially along the length of the cassette body 12. The staple guide member 22 is of a substantially H-shaped cross-section and includes two parallel leg portions 24 opposed to each other and a transverse connecting portion 26 connecting these leg portions 24 with each other. In the illustrated embodiment, each of the leg portions 24 has a lateral lug 28 with the side thereof engaged by the lower end portion of the corresponding side wall 14 of the cassette body 12. Each of the lateral lugs 28 is formed with projections 30 (FIG. 8) spaced suitably from one another along the length of the lateral lug 28. Each of these projections 30 is fitted into a longitudinally extending slot 32 formed on the corresponding side wall of the cassette body 12 near its lower end and at the corresponding position thereon. Thus, the staple guide member 22 will rigidly be mounted on the cassette body 12.

Each of the leg portions 24 on the staple guide member 22 extends from a position near the bottom of the cassette body 12 to a position near the inner face of the top wall 16. The outer side face 24A of each of the leg portions 24 is spaced apart from the inner face of the corresponding side wall 14 of the cassette body 12. An inverted U-shaped space capable of receiving inverted U-shaped staples is thus defined by a plane including the top faces of the leg portions 24 of the staple guide member 22 and the outer side faces 24A of the leg portions 24, as seen best from FIGS. 7 and 8. In this connection, a plurality of reinforcement ribs 22A are provided between the leg portions 24 below the transverse connecting portion 26 of the staple guide member 22 and spaced along the length of the staple guide member 22.

As seen best from FIG. 6, the cassette 10 of the present invention also includes feeder means comprising a slidable feeder element 31 which includes a leg portion 34 received between each leg portion 24 of the staple guide member 22 and the corresponding side wall 14 of the cassette body 12, a top portion 36 connecting the leg portions 34 with each other, and a central portion 38 extending from the top portion 36 into the space between the leg portions 24 of the staple guide member 22. The central portion 38 of the feeder element 31 is formed with an opening 38A axially extending therethrough. The opening 38A slidably receives a guide rod 40 extending therethrough substantially along the length of the cassette body 12.

The guide rod 40 has its rearward end rigidly connected with the inner face of a cap 42 which may be mounted on the opened end of the cassette body 12 to close it. The cap 42 includes a pair of spring elements 44 (only one shown in FIG. 5) extending in the same direction at the opposite sides of the guide rod 40. Each of the spring elements 44 includes an outwardly extending projection 46 which may engage in a corresponding slot 48 formed in the cassette body 12 adjacent to the rearward end thereof. On engagement of the projections 46 in the respective slots 48, the cap 42 can detachably be mounted on the cassette body 12 at its opened rearward end.

The feeder means further includes a coil-like compression spring 50 operatively mounted between the inner face of the cap 42 and the rearward face of the central portion 38 of the feeder element 31. This compression spring 50 resiliently urges the feeder element 31 forwardly along the length of the guide rod 40. When a set of staples (not shown) are charged in the cassette body 12 forwardly of the feeder elements 31, the set of staples will be urged toward the forward end of the cassette body 12.

In such an arrangement, the leg portions 24 of the staple guide member 22 extend from the respective lateral lugs 28 on the bottom thereof to a level near the inner face of the top wall 16 of the cassette body 12. Therefore, if the height of the leg portions 24 is determined to match the maximum height of the legs of the inverted U-shaped staples to be used, various staples 60 having differently sized legs 60A, 60B, 60C and 60D as shown in FIG. 1 can be received in the one and same cassette. Although FIG. 1 simultaneously shows various staples having legs of different sizes, it will be apparent that a set of staples having legs of a single size are normally contained within the cassette body.

Figure 12:
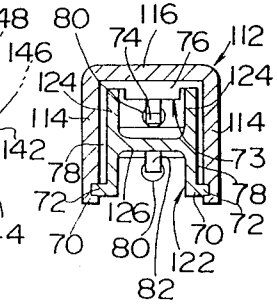
FIG. 12 is a cross-sectional view of the cassette shown in FIG. 11.
Figure 11:
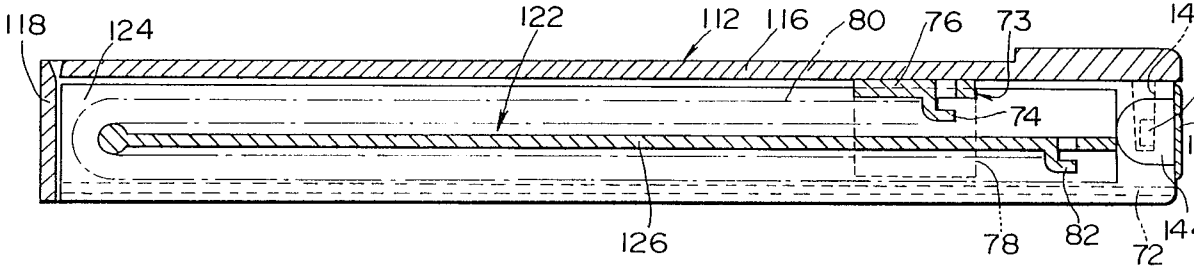
FIG. 11 is a view similar to FIG. 5, showing a second embodiment of the cassette according to the present invention.

FIGS. 11 and 12 show the second embodiment of the cassette constructed in accordance with the present invention. The second embodiment is different from the first embodiment in that a staple guide member of the second embodiment will slidably be inserted into a cassette body through its opened rearward end. Furthermore, how to urge a feeder element is also different from that of the first embodiment of the present invention. In these figures, parts similar to those of the first embodiment are designated by reference numerals similar to those of the first embodiment but added by a hundred.

In the second embodiment, the staple guide member 122 is of substantially H-shaped cross-section as in the first embodiment, but includes lateral lugs 70 extending from the lower ends of the respective leg portions 124 at right-angle. Each of the lugs 70 is adapted to engage in a longitudinally extending groove 72 which is formed on the inner face of the corresponding side wall 114 of the cassette body 112 adjacent to its lower end. Each of the longitudinal grooves 72 has its opened rearward end. Therefore, the staple guide member 122 can slidably be inserted at its lateral lugs 70 into the grooves 72 through their opened rearward ends. Thus, the staple guide member 122 can be mounted on the cassette body 112. When so mounted, the staple guide member 122 co-operates with the inner faces of the cassette body 112 to form a space for containing inverted U-shaped staples therein as in the first embodiment.

In the second embodiment, feeder means comprises a feeder element 73 which includes a top portion 76 having a first hook element 74 located between the leg portions 124 of the staple guide member 122 and leg portions 78 connected with each other by the top portion 76. Each of the leg portions 78 in the feeder element 73 is similarly located between the inner face of the corresponding side wall 114 of the cassette body 112 and the outer side face of the corresponding leg portion 124 of the staple guide member 122. The feeder means also comprises a coil-like tension spring 80 connected at one end with the first hook element 74 of the feeder element 73. The tension spring 80 extends forwardly from the first hook element 74 between the leg portions 124 of the staple guide member 122, passes around the forward end of the staple guide member and further extends rearwardly below the connecting portion 126 of the staple guide member 122. The other end of the tension spring 80 is attached to a second and downwardly extending hook element 82 which is formed on a cross member 126 of the staple guide member 122 adjacent to its rearward end. As in the first embodiment, therefore, the feeder element 73 is resiliently biased forwardly within the cassette body 112. To smoothen the molten of the tension spring 80, it is preferred that the transverse connecting portion 126 of the staple guide member 122 has a circular cross-section at its forward end, as shown in FIG. 11.

Figure 14:
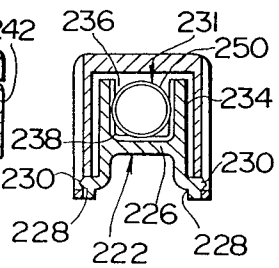
FIG. 14 is a cross-sectional view of the cassette shown in FIG. 13.
Figure 13:
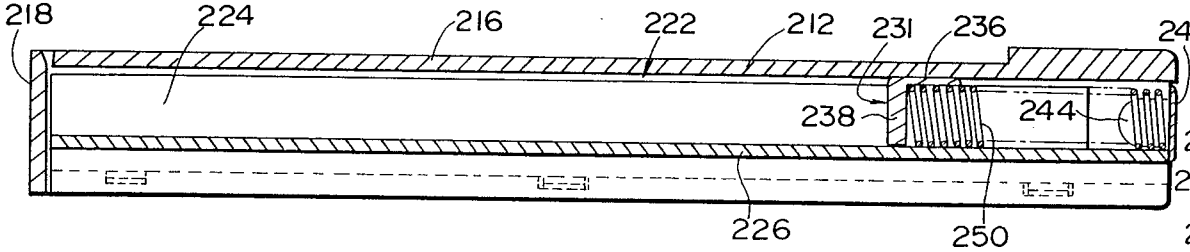
FIG. 13 is a view similar to FIG. 5, showing a third embodiment of the cassette according to the present invention.

Referring now to FIGS. 13 and 14, there is shown a third embodiment of the present invention which is substantially similar to the first embodiment except the construction of the feeder means. Thus, similar parts are designated by similar reference numeral added by two hundred.

In the third embodiment, feeder means comprises a feeder element 231 which is similar to that of the first embodiment, but includes no opening formed through the central portion 238 of the feeder element 231. Between the feeder element 231 and a cap 242 there is operatively located a coil-like compression spring 250 which has an external diameter larger than that of the compression spring in the first embodiment but slightly smaller than a distance between two leg portions 224 of a staple guide member 222. Thus, the compression spring 250 is held in place between the inner faces of the leg portions 224. The compression spring 250 of the third embodiment also resiliently urges the feeder element 231 forwardly, as in the first embodiment.

Figure 15:
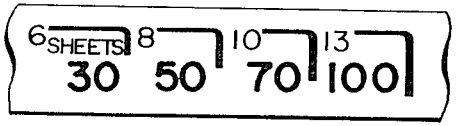
FIG. 15 illustrates an example of indicator means used to recognize the size of staples being charged into the cassette according to the present invention.

In the first to third embodiments mentioned hereinbefore, it is preferred that at least one side wall of the cassette body is made of a transparent material and that the transparent side wall has an indicator means such as printed marks for indicating the height of the legs of staples to be used and/or the number of document sheets to be bound by staples which can be used in that cassette. One example of such indicator means is shown in FIG. 15. This is very convenient since the operator can visually recognize the sort of staples now charged in the cassette and the number of document sheets which can be bound by that charged staples.

How to charge a set of staples into the cassette body in the above mentioned embodiments will easily be apparent for a person skilled in the art. For caution sake, however, it will simply be described below.

Referring first to the first and third embodiments, it is first assumed that the staple guide member (22 or 222) has been mounted on the opened bottom of the cassette body (12 or 212). As seen from in FIG. 1, a set of inverted U-shaped staples are then charged into the space formed between the inner walls of the cassette body (12 or 212) and the leg portions (24 or 224) of the staple guide member (22 or 222) through the opened rearward end of the cassette body (12 or 212). Subsequently, the feeder element (31 or 231) is similarly charged into the same space and then the compression spring (50 or 250) is inserted into the cassette body (12 or 212). Thereafter, the cap (42 or 242) is mounted to close the opened rearward end of the cassette body (12 or 212). In the first embodiment, the guide rod 40 is simultaneously inserted into the opening 38A in the central portion 38 of the feeder element 31.

According to the second embodiment, the tension spring 80 is first attached at one end to the second hook element 82 of the staple guide member 122. The other end of the tension spring 80 is then attached to the first hook element 74 of the feeder element 73. The feeder element 73 is held on the leg portions 124 of the staple guide member 122 while placing a set of staples around the leg portions 124 of the staple guide member. Keeping such a condition, the lateral lugs 72 of the staple guide member 122 are then inserted into the grooves 72 of the cassette body 112 through their opened rearward ends. The staple guide member 122 is moved forwardly within the cassette body 112 with the feeder element 73 being mounted therein simultaneously.

When it is wanted to charge another set of staples into the same cassette body, the cap can easily be removed from the cassette body simply by inwardly moving the projections on the spring elements (44, 144 or 244) of the cap (42, 142 or 242) through the slots of the cassette body. Thereafter, a new set of staples can be charged into the cassette body and the feeder means can be set therein, in the same manner as previously described.

I claim:

1. In a stapler having a base member, a cassette mounting member pivotally mounted on the base member and a handle pivotally mounted on the cassette mounting member, the handle having a staple driving blade disposed substantially at the forward end thereof, a cassette comprising, in combination:

(a) an elongated cassette body (112) of substantially U-shaped cross-section having spaced parallel side walls (114) and a top wall (116) connecting said side walls at their tops, (b) said top wall having a forward end formed with a staple driving aperture (20) through which the driving blade of the handle can pass, (c) said cassette body having at least one transparent side wall for visually exposing staples disposed within the cassette and/or document sheets disposed in a position to be bound by the staples, (d) and visually observable indicia (FIG. 15) disposed on said transparent side wall for indicating the leg length of exposed staples disposed within the cassette and/or the number of said document sheets.

2. In a stapler having a base member, a cassette mounting member pivotally mounted on the base member and a handle pivotally mounted on the cassette mounting member, the handle having a staple driving blade disposed substantially at the forward end thereof, a cassette comprising, in combination:

(a) an elongated cassette body (112) of substantially U-shaped cross-section having spaced parallel side walls (114) and a top wall (116) connecting said side walls at their tops, (b) said top wall having a forward end formed with a staple driving aperture (20) through which the driving blade of the handle can pass, (c) said cassette body having an open bottom, a closed forward end and an open rearward end, (d) a staple guide member (122) of substantially H-shaped cross-section mounted on the open bottom of said cassette body and generally coextensive therewith and forming an elongated space therewith, (e) said staple guide member including a pair of parallel leg portions (124) opposed to each other and extending from near said open bottom toward said top wall (116) of said cassette body, (f) a transverse connecting portion (126) connecting said leg portions near the lower ends of the latter, (g) the top of each of said leg portions being spaced from said top wall (124) of said cassette body, and each of said leg portions being spaced from the corresponding side wall of said cassette body, (h) a feeder element (31) engageable with the rearwardmost staple of a staple set disposed in said space, (i) a first hook (74) on said feeder element (31) and disposed above said connecting portion (126) between said leg portions of said staple guide member, (j) a second hook (82) extending downwardly from said connecting portion adjacent the rearward end of said staple guide member, (k) and a tension spring (80) for resiliently urging said feeder element toward the forward end of said cassette body, (l) said spring having opposite ends attached to said first and second hooks in a manner so that said spring extends forwardly from adjacent the rearward end of said guide member (122) and passes around the forward end thereof and then extends rearwardly back to said feeder element (31).

3. The cassette of claim 2

(a) in which said cassette body (12, 112) has at least one transparent side wall for visually exposing staples disposed within the cassette and/or document sheets disposed in a position to be bound by the staples, (b) and visually observable indicia (FIG. 15) disposed on said transparent side wall for indicating the leg length of exposed staples disposed within the cassette and/or the number of said document sheets.

* * * * *